US008573595B2

(12) United States Patent
Pirouzkhah et al.

(10) Patent No.: US 8,573,595 B2
(45) **Date of Patent: *Nov. 5, 2013**

(54) VARIABLE POINT GENERATION CRAPS GAME

(76) Inventors: Alireza Pirouzkhah, Downey, CA (US); Susan Louise Melendez, Montebello, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/437,829

(22) Filed: Apr. 2, 2012

(65) Prior Publication Data

US 2012/0187628 A1 Jul. 26, 2012

Related U.S. Application Data

(60) Continuation of application No. 12/118,576, filed on May 9, 2008, which is a continuation of application No. 11/633,052, filed on Dec. 4, 2006, now abandoned, which is a division of application No. 10/691,138, filed on Dec. 21, 2003, now Pat. No. 7,258,341.

(51) Int. Cl.
*A63F 9/04* (2006.01)

(52) U.S. Cl.
USPC ..... 273/146

(58) Field of Classification Search
None
See application file for complete search history.

(56) References Cited

U.S. PATENT DOCUMENTS

| | | | |
|---|---|---|---|
| 103,774 | A | 5/1870 | Plumb |
| 507,930 | A | 10/1893 | Ranney |
| 519,326 | A | 5/1894 | Davids |
| 645,961 | A | 3/1900 | Kingwill |
| 672,354 | A | 4/1901 | Comstock |
| 715,474 | A | 12/1902 | Gaylor |
| 779,229 | A | 1/1905 | Mansfield |
| 1,204,006 | A | 12/1916 | Goldmerstein |
| 1,236,094 | A | 8/1917 | Lloyd |

(Continued)

FOREIGN PATENT DOCUMENTS

| | | |
|---|---|---|
| CA | 510065 | 2/1955 |
| CA | 653227 | 12/1962 |

(Continued)

OTHER PUBLICATIONS

Scarne, John; Scarne's Encyclopedia of Games; 1973; pp. 319-321, 454-497.

(Continued)

*Primary Examiner* — Kurt Fernstrom
*Assistant Examiner* — Dolores Collins
(74) *Attorney, Agent, or Firm* — Snell & Wilmer LLP

(57) ABSTRACT

A variable point generation craps game includes a random indicator generator providing only members of a predetermined set of indicators, at least two point value selectors and a bet. Each of the indicators designates a point value selector, each of which has an initial state providing all possible point values obtainable, and with the same probability, from a single roll of a standard pair of dice. The point value selectors yield at least one point for the craps game upon designation by the random indicator generator. The bet depends upon at least one point value selected by at least one of the point value selectors. In a variation, a single point value selector is used and the random indicator generator designates an integer that determines a predetermined operation to be performed upon the point value selector to yield at least one point for the craps game.

19 Claims, 3 Drawing Sheets

(56) References Cited

U.S. PATENT DOCUMENTS 1,282,964 A 10/1918 Simcox
1,303,808 A 5/1919 Landis
D59,761 S 11/1921 McCarthy
1,490,153 A 4/1924 Wischhusen et al.
1,492,073 A 4/1924 Cornell
1,573,384 A 2/1926 Lieske
1,615,982 A 2/1927 Jewett
1,663,385 A 3/1928 Reinheimer
1,674,533 A 6/1928 Templeton
1,692,402 A 11/1928 Barthel
D89,035 S 1/1933 Chalk
1,998,690 A 4/1935 Shepherd et al.
2,077,124 A 4/1937 Miller et al.
D106,967 S 11/1937 Danon
2,159,958 A 5/1939 Sachs
D122,038 S 8/1940 Toombs
2,253,787 A 8/1941 Kelly
2,370,229 A 2/1945 Buckley
2,457,020 A 12/1948 Whitney
D158,996 S 6/1950 Packard
2,560,187 A 7/1951 Post
2,649,305 A 8/1953 Schoultz
2,717,782 A 11/1955 Droll
2,743,107 A 4/1956 Hollossy
2,747,877 A 5/1956 Howard
2,799,504 A 7/1957 Keyko
D190,503 S 6/1961 Barron
3,104,106 A 9/1963 Kenney et al.
3,236,362 A 2/1966 Hackbarth et al.
3,305,237 A 2/1967 Granius
3,399,879 A 9/1968 Mitchel
3,399,897 A 9/1968 Mitchell
3,433,483 A 3/1969 Ellis
D216,720 S 3/1970 Mitchell
3,533,627 A 10/1970 Deffenbaugh et al.
3,598,414 A 8/1971 Dhiegh
3,603,593 A 9/1971 Chew
3,614,105 A 10/1971 Dandini
3,661,389 A 5/1972 Harris et al.
D227,967 S 7/1973 Scarne
3,747,935 A 7/1973 Engelbrecht
3,779,555 A 12/1973 Wimberly
3,810,112 A 5/1974 Aho et al.
3,819,186 A 6/1974 Hinterstocker
3,826,498 A 7/1974 Monek
3,829,098 A 8/1974 Umminger, Jr.
3,834,710 A 9/1974 Sousan
3,889,954 A 6/1975 Malisow
3,897,953 A 8/1975 Hovnanian
3,897,954 A 8/1975 Erickson et al.
3,904,208 A 9/1975 Grossman
3,910,581 A 10/1975 Nicholson
3,913,919 A 10/1975 Carpenter
3,944,230 A 3/1976 Fineman
3,975,022 A 8/1976 Figueroa
3,998,462 A 12/1976 Goott
4,005,866 A 2/1977 Marcil
4,015,850 A 4/1977 Russell
4,019,746 A 4/1977 Hare
4,030,210 A 6/1977 Stebbins et al.
4,047,719 A 9/1977 Sajkovic
D246,732 S 12/1977 Picataci
4,077,631 A 3/1978 Tela, Jr.
4,089,527 A 5/1978 Roth
D250,054 S 10/1978 Crawford
4,129,304 A 12/1978 Mager
4,149,728 A 4/1979 Thompson
4,222,561 A 9/1980 Whitten
4,230,316 A 10/1980 Harper
4,239,226 A 12/1980 Palmer
4,241,924 A 12/1980 Arcara
4,247,114 A 1/1981 Carroll
4,279,422 A 7/1981 Shaw
4,309,038 A 1/1982 Spoon
4,310,160 A 1/1982 Willette et al.
4,312,508 A 1/1982 Wood
D263,975 S 4/1982 Quiroga et al.
4,334,685 A 6/1982 Robbins et al.
4,339,134 A 7/1982 Macheel
4,345,761 A 8/1982 China
4,346,900 A 8/1982 Lamlee
4,355,812 A 10/1982 McCullough
D266,859 S 11/1982 Skender
4,362,303 A 12/1982 Pell
4,382,602 A 5/1983 Cusick et al.
D270,361 S 8/1983 de Gregorio et al.
4,397,469 A 8/1983 Carter, III
4,421,312 A 12/1983 Delgado et al.
4,421,315 A 12/1983 Cutler
4,443,012 A 4/1984 Makovic et al.
D275,116 S 8/1984 Mickens
4,465,279 A 8/1984 Larson
4,480,838 A 11/1984 Aharonian
4,497,488 A 2/1985 Plevyak et al.
4,506,893 A 3/1985 Perry
4,512,580 A 4/1985 Matviak
4,513,969 A 4/1985 Samsel, Jr.
4,515,367 A 5/1985 Howard
4,515,369 A 5/1985 Johnson
4,573,688 A 3/1986 Grimes
4,575,085 A 3/1986 Ollington
4,586,712 A 5/1986 Lorber et al.
4,614,342 A 9/1986 Takashima
4,635,938 A 1/1987 Gray
4,643,431 A 2/1987 Hilinsky
4,648,602 A 3/1987 Maroney
4,651,997 A 3/1987 Wood
4,659,082 A 4/1987 Greenberg
4,667,959 A 5/1987 Pfeiffer et al.
4,688,803 A * 8/1987 Ollington ..... 273/274
4,711,453 A 12/1987 Saint Ive
4,743,025 A 5/1988 Gramera
4,743,031 A * 5/1988 Lamle ..... 273/146
4,746,126 A * 5/1988 Angileri ..... 273/249
4,770,421 A 9/1988 Hoffman
4,805,909 A 2/1989 Roland
4,807,884 A 2/1989 Breeding
4,832,342 A 5/1989 Plevyak et al.
4,834,386 A 5/1989 Rosenthal et al.
4,838,557 A 6/1989 Floyhar
4,861,041 A 8/1989 Jones et al.
4,887,819 A 12/1989 Walker
4,893,816 A 1/1990 Levy et al.
4,900,034 A 2/1990 Bereuter
4,902,019 A * 2/1990 Berman ..... 273/256
4,930,780 A 6/1990 Goodman et al.
4,936,588 A 6/1990 Radar et al.
4,940,241 A 7/1990 Faraci, Jr.
4,941,665 A 7/1990 Klamer
4,953,864 A 9/1990 Katz
4,962,930 A 10/1990 Griffith
4,969,648 A 11/1990 Hollinger et al.
D314,018 S 1/1991 Rosenthal
4,989,874 A 2/1991 Freitas
5,000,453 A 3/1991 Stevens et al.
5,009,430 A * 4/1991 Yuhasz ..... 273/255
5,013,040 A 5/1991 Schiehl
5,018,744 A 5/1991 Patracuolia
5,026,068 A 6/1991 Weisser
5,050,888 A 9/1991 Schultz et al.
5,078,404 A 1/1992 Barillaro et al.
5,078,405 A 1/1992 Jones et al.
5,083,793 A 1/1992 Sanford
5,096,197 A 3/1992 Embury
5,098,107 A 3/1992 Boylan et al.
5,100,139 A 3/1992 Di Bella
5,102,135 A 4/1992 Addiechi
5,118,114 A 6/1992 Tucci
5,120,939 A 6/1992 Clams et al.
5,125,660 A 6/1992 Stahl
5,133,559 A 7/1992 Page
5,150,900 A 9/1992 Onzo
5,176,381 A 1/1993 Winters
5,184,821 A 2/1993 Korenek

(56) References Cited

U.S. PATENT DOCUMENTS 5,203,564 A 4/1993 Brozas
5,226,664 A 7/1993 Bodkin, Sr.
5,228,698 A 7/1993 Dubarry, Jr.
5,240,140 A 8/1993 Huen
5,248,142 A 9/1993 Breeding
5,249,809 A 10/1993 Wolf
5,257,789 A 11/1993 LeVasseur
5,259,616 A 11/1993 Bergmann
5,261,666 A 11/1993 Chen
5,261,667 A 11/1993 Breeding
5,261,671 A 11/1993 Wyatt
5,265,009 A 11/1993 Colavita
5,265,881 A 11/1993 Doherty
5,275,411 A 1/1994 Breeding
5,288,077 A 2/1994 Jones
5,288,081 A 2/1994 Breeding
5,289,542 A 2/1994 Kessler
D344,767 S 3/1994 Wesselmann
D345,767 S 4/1994 Ollington
5,303,921 A 4/1994 Breeding
5,308,081 A 5/1994 Bartle
5,314,193 A 5/1994 Ferrer
5,314,194 A 5/1994 Wolf
5,344,146 A 9/1994 Lee
5,350,175 A 9/1994 DiLullo et al.
5,356,145 A 10/1994 Verschoor
5,364,104 A 11/1994 Jones et al.
5,377,973 A 1/1995 Jones et al.
5,382,024 A 1/1995 Blaha
5,388,830 A 2/1995 Dixson
5,393,067 A 2/1995 Paulsen et al.
5,395,119 A 3/1995 Jacob et al.
5,397,128 A 3/1995 Hesse et al.
5,405,145 A 4/1995 Jones et al.
5,407,208 A 4/1995 Keller et al.
5,417,430 A 5/1995 Breeding
5,425,537 A 6/1995 Vogelsang
5,431,399 A 7/1995 Kelley
5,431,407 A 7/1995 Hofberg et al.
5,437,462 A 8/1995 Breeding
5,445,377 A 8/1995 Steinbach
D362,029 S 9/1995 Nelson
5,456,467 A 10/1995 Hoover
5,472,194 A 12/1995 Breeding et al.
5,487,547 A 1/1996 Hobert
5,490,670 A 2/1996 Hobert
5,513,850 A * 5/1996 Vancura ..... 273/274
5,513,851 A 5/1996 Harris
5,536,016 A 7/1996 Thompson
5,538,252 A 7/1996 Green
5,540,442 A 7/1996 Orselli et al.
D372,940 S 8/1996 Ryan
5,542,671 A * 8/1996 Stewart ..... 273/146
5,544,892 A 8/1996 Breeding
5,544,893 A 8/1996 Jones et al.
5,551,700 A 9/1996 Druce et al.
5,560,613 A 10/1996 Nguyen
5,570,885 A 11/1996 Ornstein
5,573,248 A 11/1996 Parra et al.
5,573,249 A 11/1996 Johnson
5,575,475 A 11/1996 Steinbach
5,584,483 A 12/1996 Sines et al.
5,584,763 A 12/1996 Kelly et al.
5,586,766 A 12/1996 Forte et al.
5,593,161 A 1/1997 Boylan et al.
5,607,161 A 3/1997 Skratulia
5,620,183 A * 4/1997 Skratulia ..... 273/146
5,632,485 A 5/1997 Woodland et al.
5,636,838 A 6/1997 Caro
5,649,704 A * 7/1997 Dobbin ..... 273/268
5,651,682 A 7/1997 Blok et al.
5,669,606 A 9/1997 Brown
5,676,372 A 10/1997 Sines et al.
5,676,375 A * 10/1997 Pirouzkhah ..... 273/274
5,690,337 A 11/1997 Somma et al.
5,692,748 A 12/1997 Frisco et al.
5,695,192 A 12/1997 Brown
5,700,010 A 12/1997 Mimier
5,718,429 A 2/1998 Keller, Jr.
5,718,431 A 2/1998 Ornstein
5,720,484 A 2/1998 Hsu
5,728,002 A 3/1998 Hobert
5,732,948 A 3/1998 Yoseloff
5,770,533 A 6/1998 Franchi
5,772,211 A 6/1998 Nazaryan et al.
RE35,864 E 7/1998 Weingardt
5,775,696 A 7/1998 Sidlow et al.
5,775,993 A 7/1998 Fentz et al.
5,785,596 A 7/1998 Hobert
5,788,239 A 8/1998 Kong
5,788,240 A 8/1998 Feinberg
5,788,574 A 8/1998 Ornstein et al.
5,791,651 A 8/1998 Bryant
D398,660 S 9/1998 Mollo et al.
5,799,941 A 9/1998 Panneton
5,806,847 A * 9/1998 White et al. ..... 273/309
5,820,128 A 10/1998 Brunelle
5,823,874 A 10/1998 Adams
5,829,748 A 11/1998 Moore, Jr.
5,829,749 A 11/1998 Hobert
5,831,527 A 11/1998 Jones, II et al.
5,839,955 A 11/1998 Mangano et al.
5,842,698 A 12/1998 Brown
5,848,936 A 12/1998 Morrison
5,851,010 A 12/1998 Feinberg
5,890,716 A 4/1999 Bofinger et al.
D409,253 S 5/1999 Zeck
5,904,353 A * 5/1999 Aldridge ..... 273/292
5,918,884 A 7/1999 DiMuro
5,924,926 A * 7/1999 Brown ..... 463/11
5,931,471 A * 8/1999 Bonito ..... 273/274
5,934,676 A 8/1999 Rubin
5,934,998 A 8/1999 Forte et al.
5,947,820 A 9/1999 Morro et al.
5,957,452 A 9/1999 Patton
5,961,119 A 10/1999 Brown
5,964,463 A * 10/1999 Moore, Jr. ..... 273/274
5,997,000 A * 12/1999 Nakano et al. ..... 273/274
6,019,368 A 2/2000 Sines et al.
6,019,373 A 2/2000 Brown
6,019,374 A 2/2000 Breeding
6,024,642 A 2/2000 Stupak
6,059,659 A 5/2000 Busch et al.
6,062,563 A 5/2000 De Keller
6,065,752 A 5/2000 Beltran
6,070,872 A 6/2000 Squitieri
6,105,962 A 8/2000 Malavazos et al.
6,117,009 A 9/2000 Yoseloff
6,120,031 A 9/2000 Adams
6,123,335 A 9/2000 Adkins
6,154,131 A 11/2000 Jones, II et al.
6,165,072 A 12/2000 Davis et al.
6,176,489 B1 1/2001 Astaneha
6,179,291 B1 1/2001 Vancura
6,203,427 B1 3/2001 Walker et al.
6,206,373 B1 3/2001 Garrod
6,213,876 B1 4/2001 Moore, Jr.
6,217,447 B1 4/2001 Lofink et al.
6,237,916 B1 5/2001 Webb
6,273,423 B1 * 8/2001 Promutico ..... 273/274
6,299,167 B1 10/2001 Sines et al.
6,299,531 B1 10/2001 Bommarito
6,302,395 B1 10/2001 Astaneha
6,311,976 B1 11/2001 Yoseloff et al.
RE37,588 E 3/2002 Ornstein
D454,165 S 3/2002 Gallo
D454,375 S 3/2002 Ryan et al.
6,386,973 B1 5/2002 Yoseloff
6,390,474 B1 5/2002 Terminel et al.
6,394,901 B1 5/2002 Marta
6,435,505 B1 8/2002 Hoffman
6,464,225 B1 10/2002 Webb
6,508,469 B2 * 1/2003 Promutico ..... 273/274
6,536,767 B1 3/2003 Keller

(56) References Cited

U.S. PATENT DOCUMENTS

| | | | | |
|---|---|---|---|---|
| 6,588,750 | B1 | 7/2003 | Grauzer et al. | |
| 6,655,689 | B1 | 12/2003 | Stasi | |
| 6,659,461 | B2 | 12/2003 | Yoseloff et al. | |
| 6,688,597 | B2 | 2/2004 | Jones | |
| 6,692,003 | B2 | 2/2004 | Potter et al. | |
| 6,749,199 | B2 | 6/2004 | Boyd | |
| 6,761,353 | B2 * | 7/2004 | Berman et al. | 273/146 |
| 6,802,508 | B2 * | 10/2004 | Moody | 273/146 |
| 6,886,830 | B1 | 5/2005 | Boyd | |
| 6,908,084 | B2 * | 6/2005 | Jackson | 273/138.2 |
| 6,913,262 | B2 | 7/2005 | Berman | |
| 7,029,009 | B2 * | 4/2006 | Grauzer et al. | 273/149 P |
| 7,165,769 | B2 | 1/2007 | Crenshaw et al. | |
| 7,185,889 | B2 * | 3/2007 | VanZanten | 273/274 |
| 7,195,242 | B2 | 3/2007 | Terminel et al. | |
| 7,201,656 | B2 | 4/2007 | Darder | |
| 7,258,341 | B2 | 8/2007 | Pirouzkhah et al. | |
| 7,328,901 | B2 | 2/2008 | Bunn et al. | |
| 7,404,765 | B2 * | 7/2008 | Soltys et al. | 463/25 |
| 7,540,498 | B2 * | 6/2009 | Crenshaw et al. | 273/274 |
| 7,753,798 | B2 * | 7/2010 | Soltys et al. | 463/47 |
| 7,769,232 | B2 * | 8/2010 | Downs, III | 382/181 |
| 2001/0015529 | A1 | 8/2001 | Allen | |
| 2001/0028147 | A1 | 10/2001 | Ornstein et al. | |
| 2001/0034264 | A1 | 10/2001 | Berman et al. | |
| 2001/0035604 | A1 | 11/2001 | Jones | |
| 2001/0042960 | A1 | 11/2001 | Lewis et al. | |
| 2002/0043766 | A1 | 4/2002 | Berman | |
| 2002/0096827 | A1 | 7/2002 | Markowiak | |
| 2002/0163125 | A1 | 11/2002 | Grauzer et al. | |
| 2003/0032471 | A1 | 2/2003 | Darder | |
| 2003/0071415 | A1 | 4/2003 | Huard et al. | |
| 2004/0173966 | A1 * | 9/2004 | Stasi | 273/274 |
| 2005/0001379 | A1 * | 1/2005 | Moore, Jr. | 273/292 |
| 2005/0212213 | A1 | 9/2005 | Inglese | |
| 2006/0163807 | A1 | 7/2006 | Crenshaw et al. | |
| 2006/0214373 | A1 | 9/2006 | Christian | |

FOREIGN PATENT DOCUMENTS

| | | |
|---|---|---|
| DE | 671494 | 1/1939 |
| DE | 4126272 | 2/1993 |
| EP | 442132 | 12/1990 |
| FR | 393917 | 11/1908 |
| FR | 421267 | 10/1910 |
| FR | 967462 | 3/1950 |
| FR | 1524470 | 4/1968 |
| GB | 515188 | 11/1939 |
| GB | 1413568 | 11/1975 |
| GB | 1432761 | 4/1976 |
| GB | 1443143 | 7/1976 |

OTHER PUBLICATIONS

Scarne, John, Scarne on Dice, 8th Revised Edition; Copyright 1945-1974, pp. 64-65, 98-99 and 461.

* cited by examiner

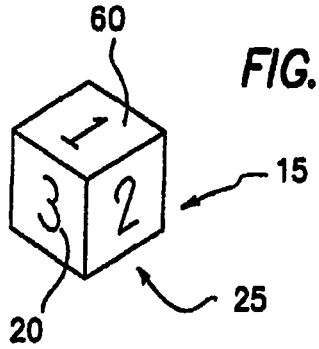
FIG. 1
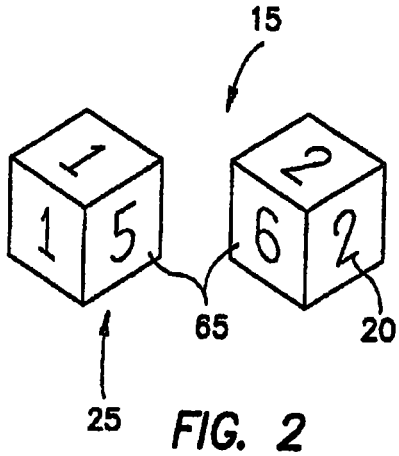
FIG. 2
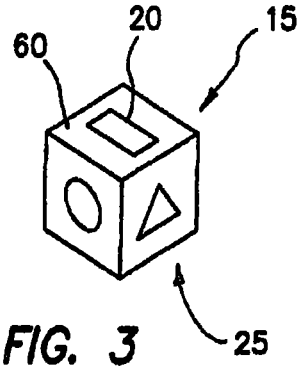
FIG. 3
FIG. 4
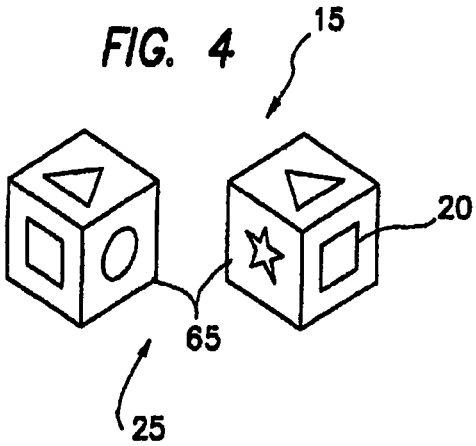

FIG. 5
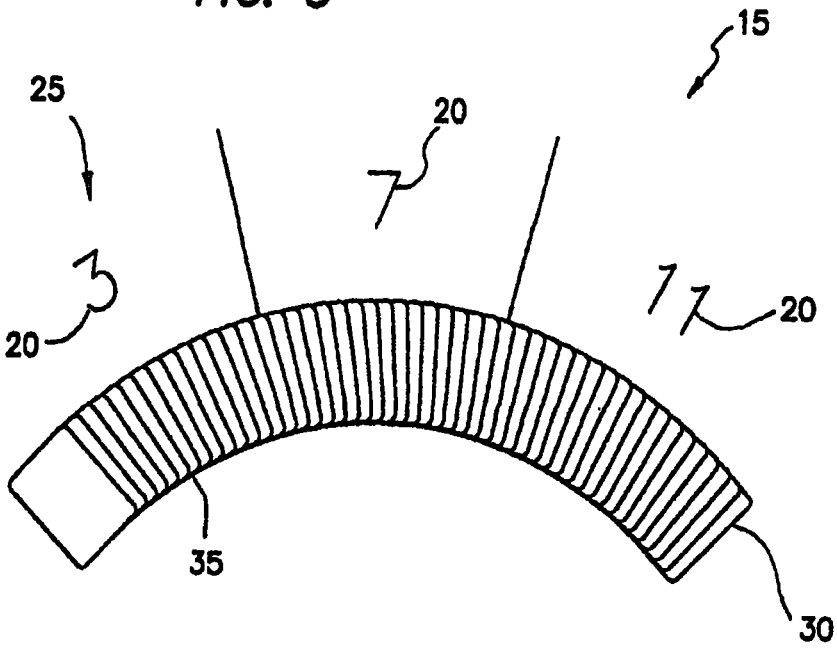
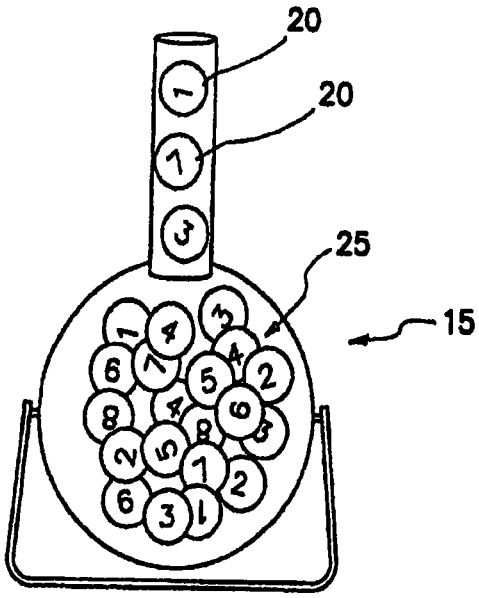
FIG. 6

VARIABLE POINT GENERATION CRAPS GAME

CROSS-REFERENCE TO RELATED APPLICATIONS

This is a continuation of U.S. patent application Ser. No. 12/118,576 filed May 9, 2008, which is a continuation of U.S. patent application Ser. No. 11/633,052 filed Dec. 4, 2006, now abandoned, which is a division of U.S. patent application Ser. No. 10/691,138, filed Oct. 21, 2003, now U.S. Pat. No. 7,258,341, entitled Variable Point Generation Craps Game. The entire disclosures of each of these applications are hereby expressly incorporated by reference herein.

FIELD OF INVENTION

The invention pertains to games of chance. More particularly, the invention relates to a variation on a dice game known as craps, however, involving a variable means of generating target and subsequent game points.

BACKGROUND

Many variations of the dice game known as craps have been developed, each attempting to add some novel feature designed to interest the gambling public. U.S. Patent Application Publication No. 2003/0032471, for Darder is directed to an apparatus for simulating games of chance with cards. In simulating a craps game, cards are used in place of dice. The cards can be special, in that all possible variations of dice outcomes are represented. Wild cards, such as jokers, can also be included. Multiple sets of cards along with multiple shufflers can also be used.

U.S. Pat. No. 5,607,161 issued to Skratulia, discloses a method of playing an improved version of 'the game of pai gow poker. Here a set of three special dice are provided which include representation of the numbers 0, 1, 2 and 4 such that when rolled, the total numeric value of the three dice would be one of the numbers 1 through 8, with each number being equally probable. Further, a revised 56-card playing deck is provided, including a 52-card standard deck plus four jokers.

U.S. Pat. No. 4,480,838, issued to Aharonian discloses a family financial board game. Here the game apparatus includes a pair of special dice where one die has an X on three of its faces and is blank on the other three faces, and the other die has an X on two of its faces, a Y on another two of its faces, and the remaining two faces are blank. Each would yield a combination of an X and a Y, an X and an X, and the casting of a blank provides a third outcome.

U.S. Pat. No. 6,302,395 issued to Astaneha is directed to a combination dice, card and roulette gambling game. In the gambling game that includes a throw of special dice, each die has a plurality of faces with a color and number on it. A plurality of cards is provided, each card having a number and a color on it. A rotatable wheel is provided that has indications for segmented areas thereon to allow a variety of creative gambling games to be played.

U.S. Pat. No. 5,690,337 issued to Somma et al. is directed to a betting game apparatus and method of play. The casino card game utilizes a single 41-card deck of playing cards consisting of a standard four suit playing card deck from which all face cards have been removed and a single joker card has been added.

While other variations exist, the above-described variations of card and dice games are typical of those encountered in the prior art. It is an objective of the present invention to provide a variation of a traditional dice crap game by utilizing special card decks designed to provide the numerical combinations available in a standard pair of dice. It is a further objective to provide such combinations in multiple decks of cards. It is a still further objective of the invention to provide a means to randomly select the deck of cards from which a card will be drawn to indicate a "point" for a craps game. It is yet a further objective to provide for the instantaneous reshuffling of a card deck after a card has been drawn and returned to the deck from which it was drawn to maintain the odds of drawing any particular point. It is also an objective to provide a means for playing a craps game utilizing a single special card deck and counting down through that deck to a card to be used as a point for the game based upon a number generated by a pair of dice or other random integer generator. Finally, it is an objective to provide a craps-type game in which the odds of drawing any particular point may change with the removal of cards from the decks.

While some of the objectives of the present invention are disclosed in the prior art, none of the inventions found include all of the requirements identified.

SUMMARY

The present invention addresses all of the deficiencies of prior art craps game inventions and satisfies all of the objectives described above.

(1) A variable point generation craps game may be constructed from the following components. A random indicator generator is provided. The random indicator generator is capable of generating only members of a predetermined set of indicators. At least low point value selectors are provided. Each of the set of predetermined indicators designates one of the at least two point value selectors. Each of the point value selectors has an initial state providing all possible point values obtainable from a single roll of a standard pair of dice. The point values are available from the point value selector with the same probability as from the standard pair of dice. Each of the point value selectors yields at least one point for the craps game upon designation by the random indicator generator. A bet is made. The bet depends upon at least one point value selected by at least one of the point value selectors.

(2) In yet another variant of the invention, the point value selector further comprises a special deck of cards. Each of the cards has an assigned point value. A top card of the special deck is drawn to yield a point for the craps game upon designation of the special deck of cards by the random indicator generator.

(3) In another variant of the invention, the special deck of cards comprises 36 standard playing cards, the 36 cards are in groups as follows: 1 "two", 2 "threes, 3 "four", 4 fives", 5 "sixes", 6 "sevens", 5 "eights", 4 "nines", 3 "tens", 2 "Aces" and 1 "Face Card", each of the cards having an assigned point value as shown on the card with each "Ace" having a point value of eleven and each "Face Card" having a point value of twelve, each of the point values providing a point for the craps game.

(4) In yet another variant, the card drawn from the special deck is returned to the special deck and the deck is either reshuffled or replaced with a reshuffled deck after yielding a point for the craps game.

(5) (Hard Way) In yet a further variant, each group of cards having an even numbered point value includes only one card of a predetermined suit. When a card of a particular point value is drawn and the card is of the predetermined suit, the point value is considered to be drawn "the hard way" resulting in a higher payoff for the bet.

(6) (Pass Line) In still a further variant, a player drawing either of a seven and an eleven prior to any other point will win the bet. A player drawing either a two, a three or a twelve prior to any other point will lose the bet. A player drawing either a four, a five, a six, an eight, a nine or a ten prior to any other point will establish that point as a target. A player drawing the target prior to drawing a seven will win the bet. A player drawing a seven prior to drawing the target will lose the bet.

(7) (Don't Pass Line) In another variant of the invention, a player drawing either a seven or an eleven prior to any other point will lose the bet. A player drawing either a two or a three prior to any other point will win the bet. A player drawing a twelve will draw again. A player drawing either a four, a five, a six, an eight, a nine or a ten prior to any other point will establish that point as a target. A player drawing the target prior to drawing a seven will win the bet. A player drawing a seven prior to drawing the target will lose the bet.

(8) (Come Bet) In still another variant, a player drawing either a seven or an eleven prior to any other point will win the bet. A player drawing either a two, a three or a twelve prior to any other point will lose the bet. A player drawing either a four, a five, a six, an eight, a nine or a ten prior to any other point will establish that point as a target. A player drawing the target prior to drawing a seven will win the bet. After establishment of the target the player places a second bet. A player drawing either a seven or an eleven prior to any other point will win the second bet. A player drawing either a two, a three or a twelve prior to any other point will lose the second bet. A player drawing either a four, a five, a six, an eight, a nine or a ten prior to any other point will establish that point as a come point. A player drawing the come point prior to drawing a seven will win the second bet. A player drawing a seven prior to drawing the come point will lose the second bet.

(9) (Don't Come Bet) In yet another variant of the invention, a player drawing either a seven or an eleven prior to any other point will win the bet. A player drawing either a two, a three or a twelve prior to any other point will lose the bet. A player drawing either a four, a five, a six, an eight, a nine or a ten prior to any other point will establish that point as a target. A player drawing the target prior to drawing a seven will win the bet. After establishment of the target the player places a second bet. A player drawing either a seven or an eleven prior to any other point will lose the second bet. A player drawing either a two or a three prior to any other point will win the second bet. A player drawing a twelve will draw again. A player drawing either a four, a five, a six, an eight, a nine or a ten prior to any other point will establish that point as a come point. A player drawing the come point prior to drawing a seven will lose the second bet. A player drawing a seven prior to drawing the come point will win the second bet.

(10) (Odds) In still another variant, after establishment of either a target or a come point a player places a third bet based upon the point value of a next draw. The third bet is based upon either a success or a failure in drawing either of the target and the come point before a seven is drawn. The third bet pays two to one if either a four or a ten is drawn, pays three to two if either a five or a nine is drawn and pays six to five if either a six or an eight is drawn.

(11) (Place Bets) In a further variant, after establishment of a target a player places a fourth bet based upon a point value of a next draw. The fourth bet is based in drawing the target before a seven is drawn. The fourth bet pays nine to a four or a ten is drawn, pays seven to five if either a five or a nine is drawn en to six if either a six or an eight is drawn.

(12) (Field Bets) In still a further variant, prior to any draw, a player places a fifth bet is based upon the point value of the first card drawn. The fifth bet pays one to one if either a three, a four, a nine, a ten or an eleven is drawn, pays two to one if either a two or a twelve is drawn and loses if either a five, a six, a seven or an eight is drawn.

(Big 6 or 8) In yet a further variant, prior to any draw, a player places a sixth bet. The sixth bet is based upon the point value of any card drawn prior to drawing a seven. The sixth bet pays one to one if either a six or an eight is drawn and pays nothing for any other point value.

(14) (Proposition Bets) In another variant of the invention, prior to any draw, a player places a seventh bet. The seventh bet is based upon the point value of the first card drawn. The seventh bet pays eight to one if either a two, a three, or a twelve is drawn, pays five to one if a seven is drawn and pays fifteen to one if an eleven is drawn.

(15) (Proposition Bets—Hard Way) In another variant, prior to any draw, a player places an eighth bet. The eighth bet is based upon the point value of any card of the predetermined suit drawn prior to drawing a seven. The eighth bet pays eight to one if either a two, a three, or a twelve is drawn and pays fifteen to one if an eleven is drawn.

(36) In still another variant of the invention, a random indicator generator is provided The random indicator generator is capable of generating only members of a predetermined set of indicators. At least two point value selectors are provided. Each of the set of predetermined indicators designates one of the at least two point value selectors. Each of the point value selectors has an initial state providing all possible point values obtainable from a single roll of a standard pair of dice. Each of the point value selectors yields at least one point for the craps game upon designation by the random indicator. A bet is made. The bet depends upon at least one point value selected by at least one of the point value selectors.

(37) In still a further variant, the point value selector further comprises a standard deck of cards. Each of the cards has an assigned point value. A top card of the standard deck is drawn to yield a point for the craps game upon designation of the standard deck of cards by the random indicator generator.

(38) In a yet another variant, the card drawn from the standard deck is returned to the standard deck and the deck is either reshuffled or replaced with a reshuffled deck after yielding a point for the craps game.

It is noted that, while bets are referred to as "second bet", "fourth bet" or "eighth bet", these are merely different types of bets and are not necessarily made in sequential order. For example, a player could make only the "sixth bet" and no others.

An appreciation of the other aims and objectives of the present invention and an understanding of it may be achieved by referring to the accompanying drawings and the detailed description of a preferred embodiment.

DESCRIPTION OF THE DRAWINGS

FIG. 1 is a perspective view of a random indicator selector employing a single dice with integers;

FIG. 2 is a perspective view of a random indicator selector employing a pair of dice with integers;

FIG. 3 is a perspective view of a random indicator selector employing a single dice with geometric designs;

FIG. 4 is a perspective view of a random indicator selector employing a pair of dice with geometric designs;

FIG. 5 is a plan view of a random indicator selector employing a deck of cards and a layout grid;

FIG. 6 is a side elevational view of a random indicator selector employing numbered balls and a ball dispenser.

DETAILED DESCRIPTION

Figure 7:
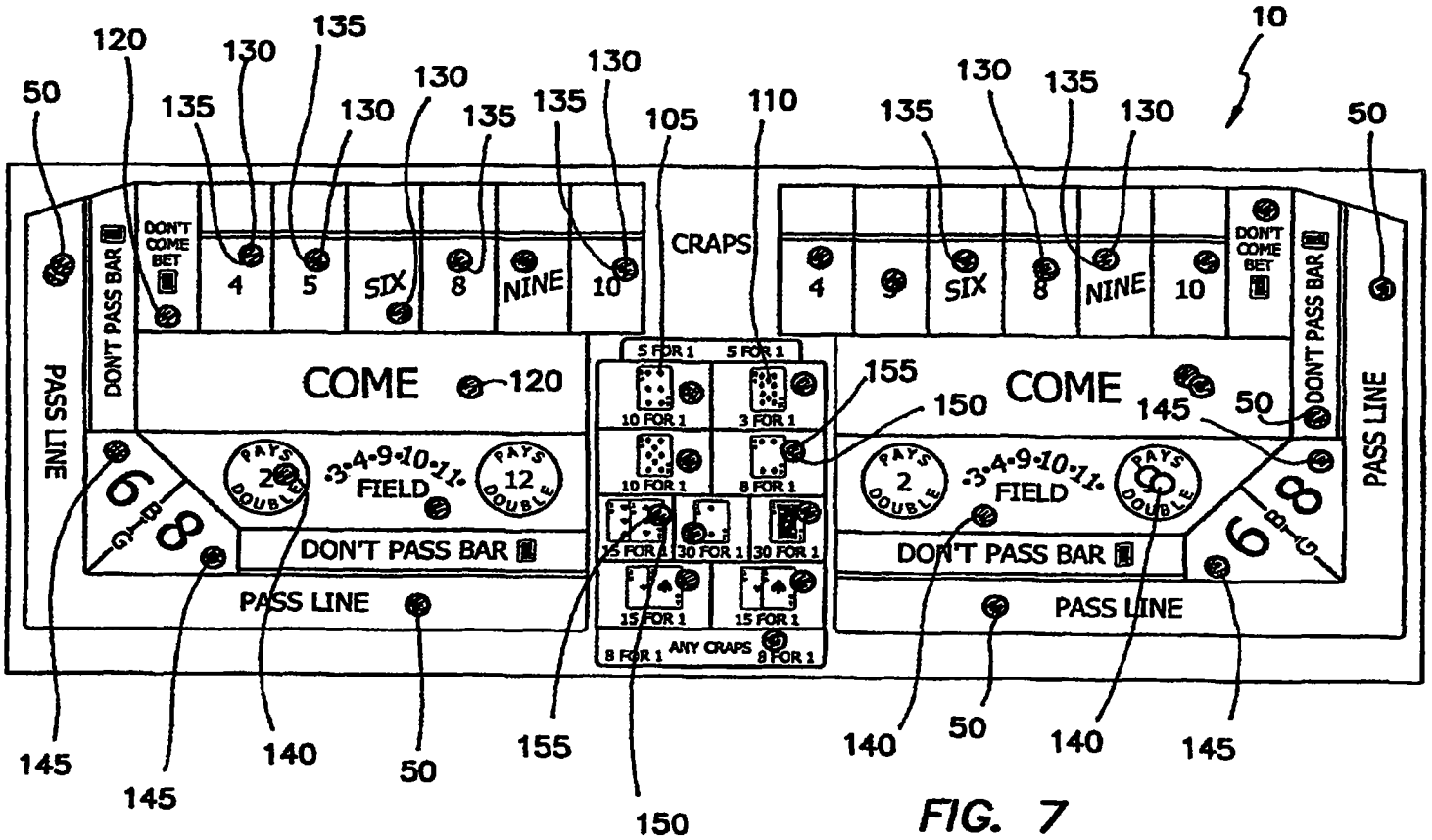
FIG. 7 is a plan view of a craps game playing surface adapted to the present invention.

FIGS. 1-7 illustrate a variable point generation craps game 10 that may be constructed from the following components. A random indicator generator 15 is provided. The random indicator generator 15 is capable of generating only members 20 of a predetermined set of indicators 25. At least two point value selectors 30 are provided. Each of the set of predetermined indicators 25 designates one of the at least two point value selectors 30. Each of the point value selectors 30 has an initial state 35 providing all possible point values not shown obtainable from a single roll of a standard pair of dice not shown. The point values are available from the point value selector 30 with the same probability as from the standard pair of dice. Each of the point value selectors 30 yields at least one point for the craps game 10 upon designation by the random indicator generator 15. A bet 50 is made. The bet 50 depends upon at least one point value selected by at least one of the point value selectors 30.

(2) In yet another variant of the invention, the point value selector 30 further comprises a special deck not shown of cards not shown. Each of the cards 75 has an assigned point value. A top card of the special deck is drawn to yield a point for the craps game 10 upon designation of the special deck of cards by the random indicator generator 15.

(3) In another variant of the invention, the special deck of cards comprises 36 standard playing cards not shown, the 36 cards are in groups as follows: 1 "two", 2 "threes, 3 "fours", 4 "fives", 5 "sixes", 6 "sevens", 5 "eights", 4 "nines", 3 "tens", 2 "Aces" and 1 "Face Card", each of the cards having an assigned point values as shown on the card with each "Ace" having a point value of eleven and each "Face Card" having a point value of twelve, each of the point values providing a point for the craps game 10.

(4) In yet another variant, the card drawn from the special deck is returned to the special deck and the deck is either reshuffled or replaced with a reshuffled deck after yielding a point for the craps game 10.

(5) (Hard Way) In yet a further variant as illustrated in FIG. 7, each group not shown of cards having an even numbered point value 105 includes only one card of a predetermined suit 110. When a card of a particular point value is drawn and the card is of the predetermined suit, the point value is considered to be drawn "the hard way" resulting in a higher payoff for the bet 50.

(6) (Pass Line) In still a further variant, a player (not shown) drawing either of a seven and an eleven prior to any other point will win the bet 50. A player drawing either a two, a three or a twelve prior to any other point will lose the bet 50. A player drawing either a four, a five, a six, an eight, a nine or a ten prior to any other point 40 will establish that point 40 as a target 115. A player drawing the target 115 prior to drawing a seven will win the bet 50. A player drawing a seven prior to drawing the target 115 will lose the bet 50.

(7) (Don't Pass Line) In another variant of the invention, a player drawing either a seven or an eleven prior to any other point will lose the bet 50. A player drawing either a two or a three prior to any other point will win the bet 50. A player drawing a twelve will draw again. A player drawing either a four, a five, a six, an eight, a nine or a ten prior to any other point will establish that point as a target not shown. A player drawing the target prior to drawing a seven will win the bet 50. A player drawing a seven prior to drawing the target will lose the bet 50.

(8) (Come Bet) In still another variant, a player drawing either a seven or an eleven prior to any other point will win the bet 50. A player drawing either a two, a three or a twelve prior to any other point will lose the bet 50. A player drawing either a four, a five, a six, an eight, a nine or a ten prior to any other point will establish that point as a target. A player drawing the target prior to drawing a seven will win the bet 50. After establishment of the target the player places a second bet 120. A player drawing either a seven or an eleven prior to any other point will win the second bet 120. A player drawing either a two, a three or a twelve prior to any other point will lose the second bet 120. A player drawing either a four, a five, a six, an eight, a nine or a ten prior to any other point will establish that point as a come point not shown. A player drawing the come point prior to drawing a seven will win the second bet 120. A player drawing a seven prior to drawing the come point will lose the second bet 120.

(9) (Don't Come Bet) In yet another variant of the invention, a player drawing either a seven or an eleven prior to any other point will win the bet 50. A player drawing either a two, a three or a twelve prior to any other point will lose the bet 50. A player drawing either a four, a five, a six, an eight, a nine or a ten prior to any other point will establish that point as a target. A player drawing the target prior to drawing a seven will win the bet 50. After establishment of the target the player places a second bet 120. A player drawing either a seven or an eleven prior to any other point will lose the second bet 120. A player drawing either a two or a three prior to any other point will win the second bet 120. A player drawing a twelve will draw again. A player drawing either a four, a five, a six, an eight, a nine or a ten prior to any other point will establish that point as a come point. A player drawing the come point 125 prior to drawing a seven will lose the second bet 120. A player drawing a seven prior to drawing the come point will win the second bet 120.

(10) (Odds) In still another variant, after establishment of either a target or a come point a player places a third bet 130 based upon the point value 40 of a next draw. The third bet 130 is based upon either a success or a failure in drawing either of the target 115 or the come point 125 before a seven is drawn. The third bet 130 pays two to one if either a four or a ten is drawn, pays three to two if either a five or a nine is drawn and pays six to five if either a six or an eight is drawn.

(11) (Place Bets) In a further variant, after establishment of a target a player places a fourth bet 135 based upon a point value of a next draw. The fourth bet 135 is based upon success in drawing the target before a seven is drawn. The fourth bet 135 pays nine to five if either a four or a ten is drawn, pays seven to five if either a five or a nine is drawn and pays seven to six if either a six or an eight is drawn.

(12) (Field Bets) In still a further variant, prior to any draw, a player places a fifth bet 140. The fifth bet 140 is based upon the point value of the first card drawn. The fifth bet 140 pays one to one if either a three, a four, a nine, a ten or an eleven is drawn, pays two to one if either a two or a twelve is drawn and loses if either a five, a six, a seven or an eight is drawn.

(13) (Big 6 or 8) In yet a further variant, prior to any draw, a player places a sixth bet 145. The sixth bet 145 is based upon the point value of any card drawn prior to drawing a seven. The sixth bet pays one to one if either a six or an eight is drawn and pays nothing for any other point value.

(14) (Proposition Bets) In another variant of the invention, prior to any draw, a player places a seventh bet 150. The seventh bet 150 is based upon the point value of the first card drawn. The seventh bet 150 pays eight to one if either a two, a three, or a twelve is drawn, pays five to one if a seven is drawn and pays fifteen to one if an eleven is drawn.

(15) (Proposition Bets—Hard Way) In a final variant, prior to any draw, a player places an eighth bet 155. The eighth bet 155 is based upon the point value of any card of the predetermined suit 110 drawn prior to drawing a seven. The eighth bet 155 pays eight to one if either a two, a three, or a twelve is drawn and pays fifteen to one if an eleven is drawn.

(36) In still another variant of the invention, a random indicator generator 15 is provided. The random indicator generator 15 is capable of generating only members 20 of a predetermined set of indicators 25. At least two point value selectors 30 are provided. Each member 20 of the predetermined set of indicators 25 designates one of the at least two point value selectors 30. Each of the point value selectors 30 has an initial state 35 providing all possible point values obtainable from a single roll of a standard pair of dice. Each of the point value selectors 30 yields at least one point for the craps game 10 upon designation by the random indicator generator 15. A bet 50 is made. The bet 50 depends upon at least one point value selected by at least one of the point value selectors 30.

(37) In still a further variant, the point value selector 30 further comprises a standard deck not shown of cards not shown. Each of the cards has an assigned point value. A top card not shown of the standard deck is drawn to yield a point for the craps game 10 upon designation of the standard deck of cards by the random indicator generator 15.

(38) In a final variant of the invention, the card drawn from the standard deck is returned to the standard deck and the deck is either reshuffled or replaced with a reshuffled deck after yielding a point for the craps game 10.

The variable point generation craps game 10 has been described with reference to particular embodiments. Other modifications and enhancements can be made without departing from the spirit and scope of the claims that follow.

What is claimed is:

1. A method of playing a craps game, the method comprising:

providing at least one indicator cube including an indicator on each side of the indicator cube;

providing a plurality of playing cards, each playing card assigned with a point value;

providing a playing surface including at least one portion for placing a user's wager thereon;

receiving, on the playing surface, a roll of the at least one indicator cube;

selecting one of the plurality of playing cards based on an indicator on one side of the at least one indicator cube that was rolled; and setting a point for the craps game using the point value assigned to the selected playing card.

2. The method of claim 1, wherein the at least one indicator cube comprises a pair of indicator cubes, wherein each cube has a feature which distinguishes one cube from the other.

3. The method of claim 2, wherein said distinguishing feature comprises a color.

4. The method of claim 1, wherein the plurality of playing cards comprises 36 playing cards, each playing card representing one of 36 possible combinations of values obtainable with two standard dice.

5. The method of claim 1, wherein the plurality of playing cards include assigned values that represent the equivalent of 1 "two", 2 "threes, 3 "fours", 4 "fives", 5 "sixes", 6 "sevens", 5 "eights", 4 "nines", 3 "tens", 2 "elevens" and 1 "twelve", each of the plurality of playing cards having an assigned point value indicated on the card.

6. The method of claim 5, wherein the plurality of playing cards comprise at least two "Ace" cards having a point value of eleven and one "Face Card" having a point value of twelve.

7. The method of claim 1, wherein the playing surface comprises a "pass" line, a "come" line, and a "proposition" betting line.

8. A method for playing a game comprising:

providing at least one die having an indicator on at least one surface of the die;

placing a plurality of cards on a playing surface;

receiving, on the playing surface, a roll of the at least one die; and mapping the indicator to at least one of the plurality of cards.

9. The method of claim 8, wherein providing at least one die having an indicator on at least one surface of the die comprises providing two dice having an indicator on at least one surface of the dice.

10. The method of claim 9, wherein at least a portion of one die of the two dice is a different color than the other die.

11. The method of claim 8, wherein the plurality of cards are selected from two separate decks of cards.

12. The method of claim 11, wherein one die has a feature that corresponds the one die to the first deck, and the other die has a feature that corresponds the other die to the second deck.

13. The method of claim 8, wherein the placing a plurality of cards on the playing surface comprises randomly placing six cards face down on the playing surface.

14. The method of claim 8, further comprising selecting a card from the plurality of cards based on the mapping of the indicator to reveal an indication on the card.

15. A method for playing a game comprising:

providing two dice having an indicator on each surface of the two dice;

placing a plurality of cards on a playing surface such that markings displayed on the playing cards are not viewable;

receiving, on the playing surface, a roll of the two dice;

mapping an indicator from the first die to at least one of the plurality of cards and mapping an indicator from the second die to at least one of the remaining plurality of cards; and revealing the markings displayed on the mapped playing cards.

16. The method of claim 15, wherein the plurality of cards are selected from two separate decks of cards.

17. The method of claim 16, wherein one die has a feature that corresponds the one die to playing cards selected from the first deck, and the other die has a feature that corresponds the other die to playing cards selected from the second deck.

18. The method of claim 15, wherein the placing a plurality of cards on the playing surface comprises randomly placing at least six cards face down on the playing surface.

19. The method of claim 15, wherein the placing a plurality of cards on the playing surface comprises placing a first set of six cards selected from a first deck and placing a second set of six cards selected from a second deck on the playing surface; and wherein mapping comprises mapping an indicator from the first die to at least one of the six cards in the first set and mapping an indicator from the second die to at least one of the six cards of the second set.

* * * * *